United States Patent [19]

Massa

[11] 4,428,206

[45] Jan. 31, 1984

[54] MEANS FOR DETECTING THE ACCUMULATION OF FROST IN A LOW TEMPERATURE REFRIGERATION SYSTEM

[75] Inventor: Frank Massa, Cohasset, Mass.

[73] Assignee: The Stoneleigh Trust, Cohasset, Mass. ; Fred M. Dellorfano, Jr. and Donald P. Massa, Trustees

[21] Appl. No.: 337,458

[22] Filed: Jan. 6, 1982

Related U.S. Application Data

[63] Continuation-in-part of Ser. No. 183,231, Sep. 2, 1980, Pat. No. 4,348,869.

[51] Int. Cl.[3] ..... F25D 21/02; F25D 21/06

[52] U.S. Cl. ..... 62/140; 62/152; 62/155; 62/234

[58] Field of Search ..... 62/140, 234, 151, 155, 62/152, 128; 200/302

[56] References Cited

U.S. PATENT DOCUMENTS

| | | | |
|---|---|---|---|
| 2,229,181 | 1/1941 | Leilich | 62/140 |
| 2,231,653 | 2/1941 | Baxter | 62/140 |
| 2,785,259 | 3/1957 | Haydon | 200/302 |
| 2,814,704 | 11/1957 | Bald | 200/302 |
| 3,127,486 | 3/1964 | Blumenshine | 62/140 X |
| 3,894,404 | 7/1975 | Stanton | 62/155 |
| 4,151,723 | 5/1979 | Gardner | 62/155 |

*Primary Examiner*—Albert J. Makay
*Assistant Examiner*—Harry Tanner

[57] ABSTRACT

A proximity sensor is mounted on a remote controlled moveable base and is used for detecting a layer of frost of a specified thickness when it accumulates on the subfreezing surface of a refrigeration system. The sensor is positioned at a distance from the subfreezing surface which is greater than the specified thickness of the frost layer which is to be detected. At periodic intervals the moveable base is driven by remote control to move the sensor closer to the subfreezing surface by an amount sufficient for the sensor to make contact with the frost layer when it has accumulated to the specified thickness to be detected.

5 Claims, 3 Drawing Figures

MEANS FOR DETECTING THE ACCUMULATION OF FROST IN A LOW TEMPERATURE REFRIGERATION SYSTEM

This is a continuation in part of my co-pending Application of the same title, Ser. No. 183,231, filed Sept. 2, 1980 now U.S. Pat. No. 4,348,869.

The co-pending Application descirbes a system for directly measuring the thickness of a frost layer which has accumulated on the subfreezing surface of refrigeration system by mounting the free end of an electromechanical transducer at a fixed specified distance from the freezer surface on which the specified thickness of frost is to be detected. The transducer vibratile element is used to control the frequency of an oscillating circuit while the free end of the transducer remains unobstructed. When the frost layer builds up to a specified thickness on the freezer surface and makes contact with the vibratile surface of the transducer to inhibit its vibration, the circuit stops oscillating and this change in circuit condition is used to initiate the defrost cycle.

This present Application provides an improvement to the operation of the system disclosed in my co-pending Application by mounting the tip of the transducer at a greater distance from the freezer surface than the specified layer thickness of frost that is to be detected. The specified thickness of the frost layer is then detected by periodically moving the mounted transducer to bring the transducer tip to the position corresponding to the specified frost layer thickness which is to be measured. When the frost layer thickness reaches the specified dimension, the transducer tip will make contact with the frost layer during its next periodic displacement and the circuit will stop oscillating and the defrost cycle will be initiated.

The primary object of this invention is to provide an improved means for automatically defrosting a refrigerating system when a specified thickness layer of frost has accumulated on the subfreezing temperature surface of the refrigerating unit.

Another object of this invention is to employ an electromechanical transducer as a frost detector probe by placing its free unobstructed surface at a fixed distance from the subfreezing temperature surface which is greater than the specified thickness layer of frost which is to be detected and periodically move the transducer closer to the subfreezing temperature surface so that its free unobstructed vibratile surface is brought to the specified distance from the subfreezing surface which corresponds to the thickness layer of frost which is to be detected. The vibratile element of the transducer is used to control the frequency of an oscillating circuit while the transducer vibratile element remains unobstructed. When the layer of frost builds up to the specified thickness and makes contact with the probe-like vibratile transducer surface during its periodic displacement, the free vibration of the transducer element will be inhibited and the circuit stops oscillating thus signalling the start of the defrost cycle.

A further object of this invention is to substitute a sealed frost-free switch for the electromechanical transducer and utilize the switch as a proximity switch that will turn on the defrost cycle when the periodic displacement of the mounted switch makes contact with the specified frost thickness layer accumulated on the subfreezing temperature surface of the refrigerator.

Other objects of the invention will become evident in the following detailed description. The novel features which are characteristic of the invention are set forth with particularity in the appended claims. The invention itself, however, both as to its organization and method operation, as well as advantages thereof, will best be understood from the following description of several embodiments thereof when read in connection with the accompanying drawings, in which:

Figure 1:
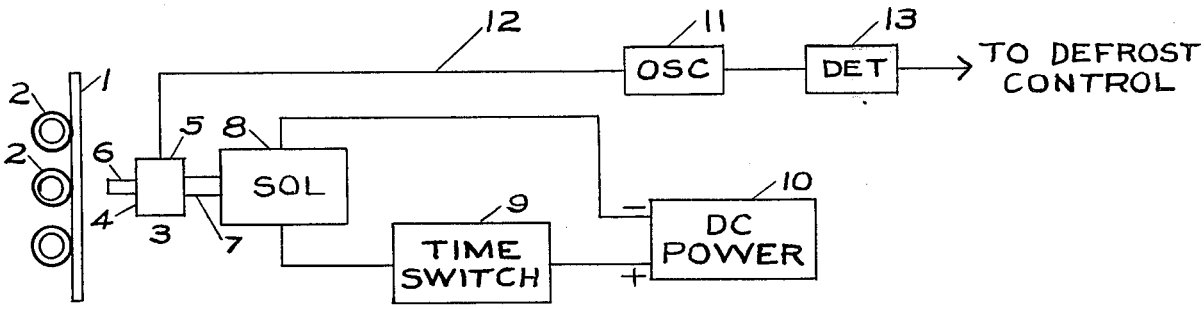
FIG. 1 is a schematic illustration of one preferred embodiment of my invention.

Referring more specifically to the figures, the reference character 1 illustrates an edge view of the refrigerated wall surface of a freezer compartment whose temperature is maintained below the freezing point of water. The cold temperature is maintained by circulating a refrigerant through the tubes 2, which are soldered to the surface of the wall plate 1 as is well known in the art. An electroacoustic transducer 3 which includes a thin vibratile diaphragm 4 cemented to the periphery of the housing 5, is driven by a thin piezoelectric ceramic disc cemented to the center of the inner surface of the diaphragm (not shown in the view of the transducer) in the well known manner familiar to anyone skilled in the art. More detailed information on various well known structures which may be used in the construction of transducer 3 may be found in U.S. Pat., Nos. 3,128,532, 3,578,995 and 3,638,052. Cemented to the center of the external surface of vibratile diaphragm 4 is a small diameter lightweight probe 6 as illustrated in FIG. 1. The transducer 3 is attached to the moveable plunger 7 of the soleniod 8 as shown schematically in FIG. 1. The solenoid housing is mounted by a bracket or any other suitable means, not shown, so that the free end of the probe 6 is spaced from the refrigerated wall surface 1 by an amount equal to the specified thickness of the layer of frost which is to be detected when it forms on the surface 1 plus an additional amount equal to the distance moved toward the wall 1 by the solenoid plunger 7 when the solenoid is actuated. In FIG. 1, the actuation of the solenoid takes place at periodic intervals as determined by the setting of the time switch 9 which is programmed to connect the output from the dc power supply 10 at the desired intervals. The electrical connection from the transducer 3 to the oscillator circuit 11 is made by the cable 12. The resonance frequency of the oscillator circuit is established by the free resonant frequency of the transducer as is well known in the art of frequency controlled circuits. While the oscillator signal is present, the detector 13 recognizes the oscillator frequency and no activation signal is sent to the defroster control circuit. When the layer of frost on surface 1 builds up to the specified thickness, the probe 6 on transducer 3 will make contact with the frost layer at the time of the next periodic activation of the solenoid 8 by the timing switch 9 and the transducer diaphragm will be prevented from vibrating and the oscillator 11 will stop oscillating. The absence of oscillation will be sensed by the detector 13, at which time the detector will send an activate signal to the defrost control circuit and automatically initiate the defrosting cycle. The specific circuit details for accomplishing the various electrical functions described are not shown because they are well known to any electronic engineer skilled in the art and the specific circuits are not part of this invention. The invention is in the novel system as described herein for automatically initiating the defrost cycle in a refrigerating system when the frost on a sub-freezing surface of the freezer unit has accumulated to a specified thickness. The frost layer thickness, when it accumulates to a specified thickness is detected by the inventive system, which in turn activates the defrost cycle. The use of the probe 6 attached to the center of the diaphragm, which is the point of maximum diaphragm displacement during its free resonant vibration while the transducer is controlling the frequency of the oscillator 11, gives increased assurance that the transducer diaphragm 4 will be prevented from continued vibration when the frost layer accumulated on the wall surface 1 reaches the specified thickness and the tip of the probe 6 makes contact with the frost surface during the next activation period of the solenoid.

The described use of the free resonant frequency of an electroacoustic transducer as a means for detecting the presence of a specified thickness layer of frost is the same as described in my co-pending Application. The only difference in the present Application is that the surface of the transducer is not held fixed as in my co-pending Application, but is held at a greater distance from the freezer wall and the transducer is periodically moved closer to the freezer wall by a fixed amount by periodically activating a solenoid 8 such that the displaced position of the transducer tip 6 is located at the specified frost layer thickness spacing from the freezer wall 1. The improvement in this new procedure is that the frost grows more naturally over the wall surface 1 when the probe 6 remains at the larger spacing from the wall. When the probe remains fixed in position relative to the wall 1 and is separated from the wall only by the thickness of the frost layer which is to be detected as described in my co-pending Application, now U.S. Pat. 4,348,869 the frost growth between the probe tip and the wall is sometimes inhibited and sometimes grows in a less dense layer which delays the complete blocking of the vibratile surface of the transducer and thereby introduces a degree of uncertainty in the exact time for starting the defrost cycle.

The piezoelectric transducer 3 as described is only one of may different transducer types that may be used as the sensor element in this invention. Other well known electromechanical and electroacoustic transducers operating on different transduction principles including electromagnetic, magnetostriction, crystal, and electrostatic as described in an article by Frank Massa entitled "Ultrasonic Transducers for Use in Air," published in the Proceedings of the Institute of Electrical and Electronics Engineers, Vol. 53, Oct. 1965, page 1363, may be used in this invention as the sensor element.

Figure 2:
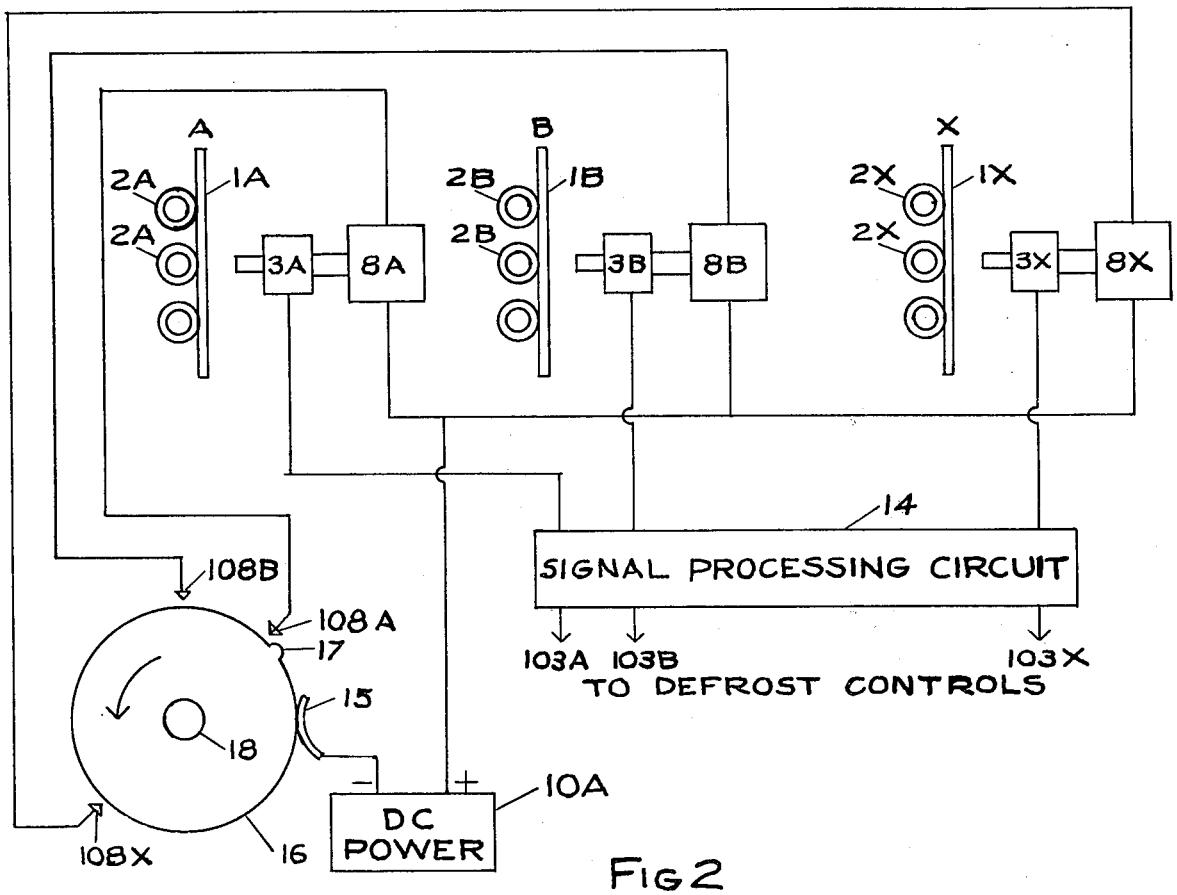
FIG. 2 is a schematic illustration of another embodiment of the invention illustrated in FIG. 1 for use in a multi-compartment freezer unit.

FIG. 2 illustrates the use of the frost detection system illustrated in FIG. 1 as applied to commercial freezers having a plurality of separated freezer sections such as are used in the frozen food section of supermarkets. Referring to FIG. 2, the separated freezer sections are indicated by A, B,–X. Each section has a refrigerated wall surface 1A, 1B,–1X with the attached cooling coils 2A, 2B,–2X. A transducer 3A, 3B,–3X is installed in each respective freezer compartment in the same manner described for the transducer 3 in FIG. 1. Electrical connection from each transducer is made to a central signal processing circuit 14 as illustrated. The dc power supply 10A has its minus polarity connected to the brush 15 which maintains spring contact with the conducting peripheral surface of the circular cam 16. The projecting tip 17 on cam 16 makes sequential periodic connection to the switch contact points 108A, 108B–108X as the cam 16 rotates in the direction of the arrow as it is driven by the rotating shaft 18. The shaft 18 is driven by a motor, not shown, at a speed necessary to establish the desired time intervals between the sequential connections. At each instant of contact of the tip 17 to a swtich contact point, the solenoid connected to the particular switch contact point is activated and the activated solenoid moves the attached transducer toward the wall surface from which it is spaced by a specified amount sufficient to bring the tip of the transducer probe at a specified closer distance to the freezer wall surface such that the closer distance becomes equal to the specified frost layer thickness which is required to be detected. The cam 16 turns continuously and each solenoid in the system is sequentially activated at continuing periodic intervals. Whenever any freezer wall surface has built up a frost layer equal to or greater than the specified closer distance to which the transducer probe tip is moved, the tip of the transducer will strike the frost surface and inhibit the free oscillation of the transducer. When this happens, the signal processing circuit 14 recognizes the absence of the oscillation and a command signal is transmitted by the signal processing circuit to initiate the defrost cycle in the particular freezer section corresponding to the non-oscillating transducer. The use of a single signal processing circuit 14 and a single cam 16 to sequentially examine the state of the various transducers associated with a plurality of separated freezer compartments as illustrated will not only reduce the cost of the frost detection equipment for use with such freezer systems, but the sequential activation of the defrost control circuits will materially reduce the peak electrical load on the system as compared to the use of an independent frost detection for each of the plurality of separated freezer compartments.

A solenoid has been used as an illustrative example of one means for moving the transducer from one position to another. It is obvious that any other well known means could be used just as effectively for moving the transducer such as an air cylinder or mechanical cam or any other suitable well known means. The invention is not in the specific means for moving the transducer, but it is in the combination of a moveable frost sensor transducer as used in the improved frost detection system as described.

Figure 3:
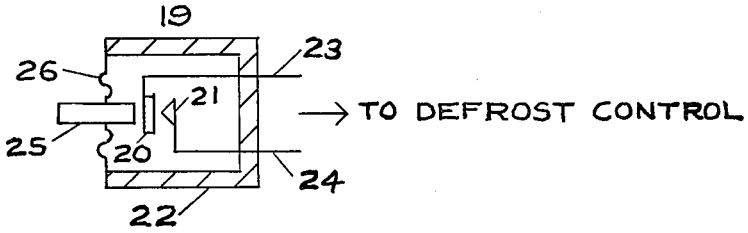
FIG. 3 is a schematic illustration of a sealed switch which can be substituted for the electroacoustic transducers in FIGS. 1 and 2 as an alternate type of frost detection element for accomplishing the automatic detection of a specified layer of frost build-up on the subfreezing temperature surface of the refrigerating system.

To further reduce the cost of the frost detection system, the illustrative acoustic transducers and the associated electronics and signal processing circuit can be substituted by a simple sealed proximity switch 19 as schematically illustrated in FIG. 3. The separated switch contacts 20 and 21 are mounted within a sealed housing 22. Electrical terminals 23 and 24 are connected to the switch contacts 21 and 22 as schematically illustrated in FIG. 3. A probe tip 25 is supported at the center of a flexible diaphragm 26 as illustrated. I have found that an elastomer such as silicone rubber makes a desirable alternative to the flexible diaphragm mounting illustrated and has the added advantage that it inhibits the build-up of frost on the exposed flexible surface. The rubber can be molded between the periphery of the tip 26 and the inside concentric surface of the housing if desired.

If the proximity switch 19 is substituted for the transducer 3 in FIG. 1 and for the transducers 3A, 3B–3X in FIG. 2 and a solenoid is activated, the corresponding attached switch will be moved closer to the freezer wall in the same manner as described previously for the movement of the electroacoustic transducers. When the frost layer builds up on the wall surface of the freezer compartment to the specified thickness, the probe 25 of the switch assembly will be displaced by a distance sufficient to close the switch contacts 20 and 21. The clearance spaces within the switch 19 are chosen such that the switch contacts 20 and 21 will close when the solenoid moves the switch by the prescribed amount of the purpose of sensing the presence of a specified frost layer on the wall surface of the freezer compartment. The closing of the switch contacts may then be used directly to initiate the defrost cycle in the corresponding freezer compartment without need for any of the electronics required with the use of the electromechanical transducers as previously described.

While a few specific embodiments of the present invention have been shown and described, it should be understood that various additional modifications and alternative constructions may be made without departing from the true spirit and scope of the invention. Therefore, the appended claims are intended to cover all such equivalent alternative constructions that fall within their true spirit and scope.

I claim:

1. Means for detecting the accumulation of a layer of frost of a specified thickness on a subfreezing surface of a refrigerating system, said detection means includes a housing structure, an electromechanical transducer element contained within said housing, said transducer element characterized in that its electrical characteristic is subject to change when said transducer element is acted upon by a mechanical force, a mechanical force transmission member, compliant mounting means attached to said housing structure and adapted for holding said force transmission member in a fixed unobstructed operable position relative to said housing structure, said mounted force transmission member characterized in that it includes an exposed unobstructed surface area portion located external to said housing structure and a non-exposed surface area portion located internal to said housing structure in close proximity to said transducer element contained within said housing, adjustable remote controlled positioning means attached to said housing structure, said adjustable positioning means characterized in that it holds said exposed unobstructed surface area portion of said force transmission member at a fixed distance from said subfreezing surface which is greater than said specified thickness layer of frost which is to be detected, a command signal power source, means for periodically connecting said command signal power source to said adjustable remote controlled positioning means thus causing said fixed distance from said subfreezing surface to be periodically reduced to a value corresponding to the specified frost layer thickness which is to be detected, whereby when a frost layer of specified thickness has formed on said subfreezing surface said force transmission member will impact directly against said frost layer and the force generated at impact upon the execution of said command signal is transmitted to said transducer element thereby causing a change in the electrical characteristic of said transducer element, detection circuit means connected to said transducer element, said detection circuit means characterized in that said change in electrical characteristic of said transducer element is recognized by said detector, the recognition of said change in electrical characteristic indicates that the frost layer thickness has accumulated to said specified thickness.

2. The invention in claim 1 and a defroster element associated with said refrigeration system, activating means for operating said defroster element, said activating means characterized in that it is responsive to said change in electrical characteristic of said transducer element when it is recognized by said detector.

3. The invention in claim 1 characterized in that said compliant means for holding said force transmission member in a fixed position relative to said housing structure comprises a flexible diaphragm attached to said housing.

4. Means for detecting the accumulation of a layer of frost of a specified thickness on the subfreezing surfaces of a plurality of separate freezer compartments in a refrigerating system, said detection means includes a proximity sensor in each compartment, said proximity sensor characterized in that it includes a housing structure, an electromechanical transducer element contained within said housing, said transducer element characterized in that its electrical characteristic is subject to change when said transducer element is acted upon by a mechanical force, a mechanical force transmission member, compliant mounting means attached to said housing structure and adapted for holding said force transmission member in a fixed unobstructed operable position relative to said housing structure, said mounted force transmission member characterized in that it includes an exposed unobstructed surface area portion located external to said housing structure and a nonexposed surface area portion located internal to said housing structure in close proximity to said transducer element contained within said housing, adjustable remote controlled positioning means attached to said housing structure, said adjustable positioning means characterized in that it holds said exposed unobstructed surface area portion of said force transmission member at a fixed distance from said subfreezing surface of its associated freezer compartment which is greater than said specified thickness layer of frost which is to be detected, a single command signal power source, means for periodically connecting said single command signal power source sequentially to each of said adjustable remote controlled positioning means thus causing said fixed distance between each sensor and its associated subfreezing surface to be periodically reduced to a value corresponding to the specified frost layer thickness which is to be detected, whereby when a frost layer of specified thickness has formed on said subfreezing surface said force transmission member will impact directly against said frost layer and the force generated at impact upon the execution of said command signal is transmitted to said transducer element thereby causing a change in the electrical characteristic of said transducer element, detection circuit means connected to said transducer element, said detection circuit means characterized in that said change in electrical characteristic of said transducer element is recognized by said detector, the recognition of said change in electrical characteristic indicates that the frost layer thickness has accumulated to said specified thickness.

5. The invention in claim 4 and a separate defroster element associated with each separate freezer compartment, separate activating means associated with each separate defroster element, each separate activating means characterized in that it is responsive to said change in electrical characteristic of said particular transducer element contained in the sensor associated with a particular freezer compartment.

* * * * *